US010667607B2

(12) United States Patent
Chen et al.

(10) Patent No.: US 10,667,607 B2
(45) Date of Patent: Jun. 2, 2020

(54) RETRACTING MECHANISM FOR MOVABLE FURNITURE PARTS

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Fang-Cheng Su, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 144 days.

(21) Appl. No.: 15/828,717

(22) Filed: Dec. 1, 2017

(65) Prior Publication Data

US 2018/0255928 A1 Sep. 13, 2018

(30) Foreign Application Priority Data

Mar. 7, 2017 (TW) ..... 106107482 A

(51) Int. Cl.

*A47B 88/04* (2006.01)
*A47B 88/467* (2017.01)
*A47B 88/477* (2017.01)

(52) U.S. Cl.

CPC ..... *A47B 88/467* (2017.01); *A47B 88/477* (2017.01); *A47B 2210/0056* (2013.01)

(58) Field of Classification Search

CPC ..... A47B 88/467; A47B 88/463; A47B 88/47; A47B 88/477; E05F 1/16

See application file for complete search history.

(56) References Cited

U.S. PATENT DOCUMENTS

| | | | | |
|---|---|---|---|---|
| 5,207,781 | A | 5/1993 | Rock | |
| 8,182,054 | B2 | 5/2012 | Liang et al. | |
| 8,721,011 | B2 * | 5/2014 | Salice | A47B 88/47 312/333 |
| 8,746,422 | B2 * | 6/2014 | Zimmer | E05F 1/16 188/265 |
| 8,899,703 | B2 * | 12/2014 | Chung | A47B 88/463 312/333 |

(Continued)

FOREIGN PATENT DOCUMENTS

WO WO-2016106434 A1 * 7/2016 ..... E05F 1/16

*Primary Examiner* — Kimberley S Wright
(74) *Attorney, Agent, or Firm* — Rosenberg, Klein & Lee

(57) ABSTRACT

A retracting mechanism for first and second furniture parts includes a guiding structure, a catch member, and a resilient member. The first furniture part includes an engaging feature. The catch member is displaceable between first and second guiding portions of the guiding structure and includes first and second features. While the second furniture part is displaced in a certain direction with respect to the first furniture part, with the catch member initially at the first guiding portion and with the engaging feature caught by one of the first and second features, the catch member is disengaged from the engaging feature such that the resilient member stores a force for assisting in retracting the second furniture part with respect to the first furniture part.

17 Claims, 16 Drawing Sheets

(56) References Cited

U.S. PATENT DOCUMENTS

| | | | | |
|---|---|---|---|---|
| 8,905,498 | B2 * | 12/2014 | Hammerle | A47B 88/40 312/333 |
| 9,211,007 | B2 * | 12/2015 | Brunnmayr | A47B 88/40 |
| 9,532,648 | B2 * | 1/2017 | Gasser | E05B 65/463 |
| 9,622,578 | B2 * | 4/2017 | Goetz | E05B 65/462 |
| 9,681,748 | B2 * | 6/2017 | Chen | A47B 88/47 |
| 9,756,940 | B2 * | 9/2017 | Chen | A47B 88/463 |
| 9,788,655 | B2 * | 10/2017 | Chen | F16C 29/008 |
| 9,820,573 | B2 * | 11/2017 | Brunnmayr | E05B 65/46 |
| 9,907,400 | B1 * | 3/2018 | Chen | A47B 88/49 |
| 9,961,998 | B2 * | 5/2018 | Chen | F16H 19/04 |
| 9,976,331 | B2 * | 5/2018 | Albrecht | E05F 15/00 |
| 10,041,728 | B2 * | 8/2018 | Go | F25D 25/024 |
| 10,051,962 | B2 * | 8/2018 | Goetz | A47B 88/407 |
| 10,172,461 | B2 * | 1/2019 | Fischer | E05F 1/16 |
| 10,251,481 | B2 * | 4/2019 | Goetz | E05F 1/16 |
| 2013/0088132 | A1 * | 4/2013 | Hammerle | A47B 88/40 312/319.1 |
| 2014/0021841 | A1 * | 1/2014 | Brunnmayr | A47B 88/57 312/319.1 |
| 2014/0210329 | A1 * | 7/2014 | Brunnmayr | E05B 65/46 312/333 |
| 2014/0327351 | A1 * | 11/2014 | Chung | A47B 88/463 312/333 |
| 2015/0374123 | A1 * | 12/2015 | Goetz | E05B 65/462 |
| 2015/0374125 | A1 * | 12/2015 | Goetz | A47B 88/463 312/319.1 |
| 2017/0265644 | A1 * | 9/2017 | Fischer | E05F 1/16 |
| 2018/0055225 | A1 * | 3/2018 | Chen | A47B 88/49 |
| 2018/0332963 | A1 * | 11/2018 | Chen | A47B 88/463 |
| 2019/0159594 | A1 * | 5/2019 | Chen | A47B 88/467 |

* cited by examiner

RETRACTING MECHANISM FOR MOVABLE FURNITURE PARTS

FIELD OF THE INVENTION

The present invention relates to a retracting mechanism and more particularly to one for use with movable furniture parts.

BACKGROUND OF THE INVENTION

Generally, an undermount drawer slide rail assembly is mounted on the bottom of a drawer and is therefore hidden from view. An undermount drawer slide rail assembly typically includes a first rail and a second rail displaceable with respect to the first rail. More specifically, the first rail is mounted on the body of a cabinet, and the second rail is configured to carry or support a drawer so that the drawer can be easily pulled out of and pushed back into the cabinet body through the second rail with respect to the first rail. The undermount drawer slide rail assembly stays hidden at the bottom of the drawer even when the drawer is pulled out of the cabinet body.

As is well known in the art of furniture slide rails, a driving device can apply a driving force to a drawer (or slide rail) when the drawer (or slide rail) is in the last stage of a retracting process moving with respect to the body of a cabinet (or another slide rail) in a retracting direction from an opened position, wherein the driving force helps close the drawer with respect to the cabinet body. U.S. Pat. No. 5,207,781, for example, discloses a closing device for moving a drawer to a fully inserted position within a furniture body. As shown in FIG. 3 and FIG. 4 accompanying the specification of this U.S. patent, a tiltable member (3) is tilted into and thus locked in the arcuate portion (4") of a guide track (4) when a drawer is moved in an opening direction with respect to a cabinet body. Consequently, a pin member (5) withdraws from a slot (9) of the tiltable member (3), allowing a spring (6) to store an elastic force. When the drawer is retracted with respect to the cabinet body, the pin member (5) reenters the slot (9) of the tiltable member (3) such that the tiltable member (3) returns to the rectilinear portion (4') of the guide track (4), with the spring (6) pulling the tiltable member (3) and thereby retracting the drawer to a closed position with respect to the cabinet body. The disclosure of this US patent is incorporated herein by reference.

SUMMARY OF THE INVENTION

The present invention relates to a retracting mechanism for movable furniture parts.

According to one aspect of the present invention, a retracting mechanism is provided for use with movable furniture parts, wherein the furniture parts include a first furniture part and a second furniture part that are displaceable with respect to each other. One of the first furniture part and the second furniture part includes an engaging feature. The retracting mechanism includes a guiding structure, a catch member, and a resilient member. The guiding structure includes a first guiding portion and a second guiding portion in communication with the first guiding portion. The catch member can be displaced between the first guiding portion and the second guiding portion and includes a first feature and a second feature that are configured to catch the engaging feature separately. When one of the first furniture part and the second furniture part is being displaced in an opening direction with respect to the other to a predetermined position, with the catch member located at the first guiding portion and with the engaging feature caught by one of the first feature and the second feature of the catch member, the catch member is disengaged from the engaging feature by the second guiding portion such that the resilient member stores a driving force. When the one of the first furniture part and the second furniture part is in the last stage of retraction with respect to the other in a retracting direction, the driving force acts on and helps retract the one of the first furniture part and the second furniture part.

Preferably, the engaging feature is located at the first furniture part, and the retracting mechanism is located at the second furniture part.

Preferably, the catch member includes a main body, a first extension portion, a second extension portion, and a third extension portion. The first extension portion, the second extension portion, and the third extension portion are connected to the main body. The third extension portion is located between the first extension portion and the second extension portion. The first feature is located between the first extension portion and the third extension portion.

Preferably, the retracting mechanism further includes a resilient leg connected to the third extension portion.

Preferably, the resilient leg is bent with respect to the third extension portion and is adjacent to the second extension portion.

Preferably, the second feature is located at the second extension portion.

Preferably, the second extension portion is made of a flexible material and includes a first section and a second section bent with respect to the first section. The first section and the second section form an engaging hook as the second feature.

Preferably, the second guiding portion of the guiding structure is offset from the first guiding portion by an angle, and the resilient leg can work directly with the engaging feature to help tilt and displace the catch member from the first guiding portion to the second guiding portion.

Preferably, the retracting mechanism further includes a base pivotally connected to the catch member, and the catch member can be displaced between the first guiding portion and the second guiding portion via a guiding member.

Preferably, the retracting mechanism further includes a cushioning device for producing a cushioning effect by reducing the driving force acting on the one of the first furniture part and the second furniture part.

Preferably, the first furniture part includes a first position-limiting feature, and the second furniture part, a second position-limiting feature. When the second furniture part is at a retracted position with respect to the first furniture part, the first position-limiting feature and the second position-limiting feature are pressed against each other to prevent the second furniture part from being displaced from the retracted position in the retracting direction.

According to another aspect of the present invention, a retracting mechanism is provided for use with movable furniture parts, wherein the furniture parts include a first furniture part and a second furniture part displaceable with respect to the first furniture part. The first furniture part includes an engaging feature. The retracting mechanism includes a guiding structure, a catch member, and a resilient member. The guiding structure includes a first guiding portion and a second guiding portion adjacent to the first guiding portion. The catch member can be displaced between the first guiding portion and the second guiding portion and includes a first feature and a second feature that are configured to catch the engaging feature separately. When the second furniture part is being displaced in an opening direction with respect to the first furniture part to a predetermined position, with the engaging feature caught by one of the first feature and the second feature of the catch member, the catch member is disengaged from the engaging feature by the second guiding portion, and the resilient member stores a driving force in response to the catch member being located at the second guiding portion. When the second furniture part is in the last stage of retraction with respect to the first furniture part in a retracting direction, the driving force drives the second furniture part into displacement to a retracted position with respect to the first furniture part.

DETAILED DESCRIPTION OF THE INVENTION

Figure 1:
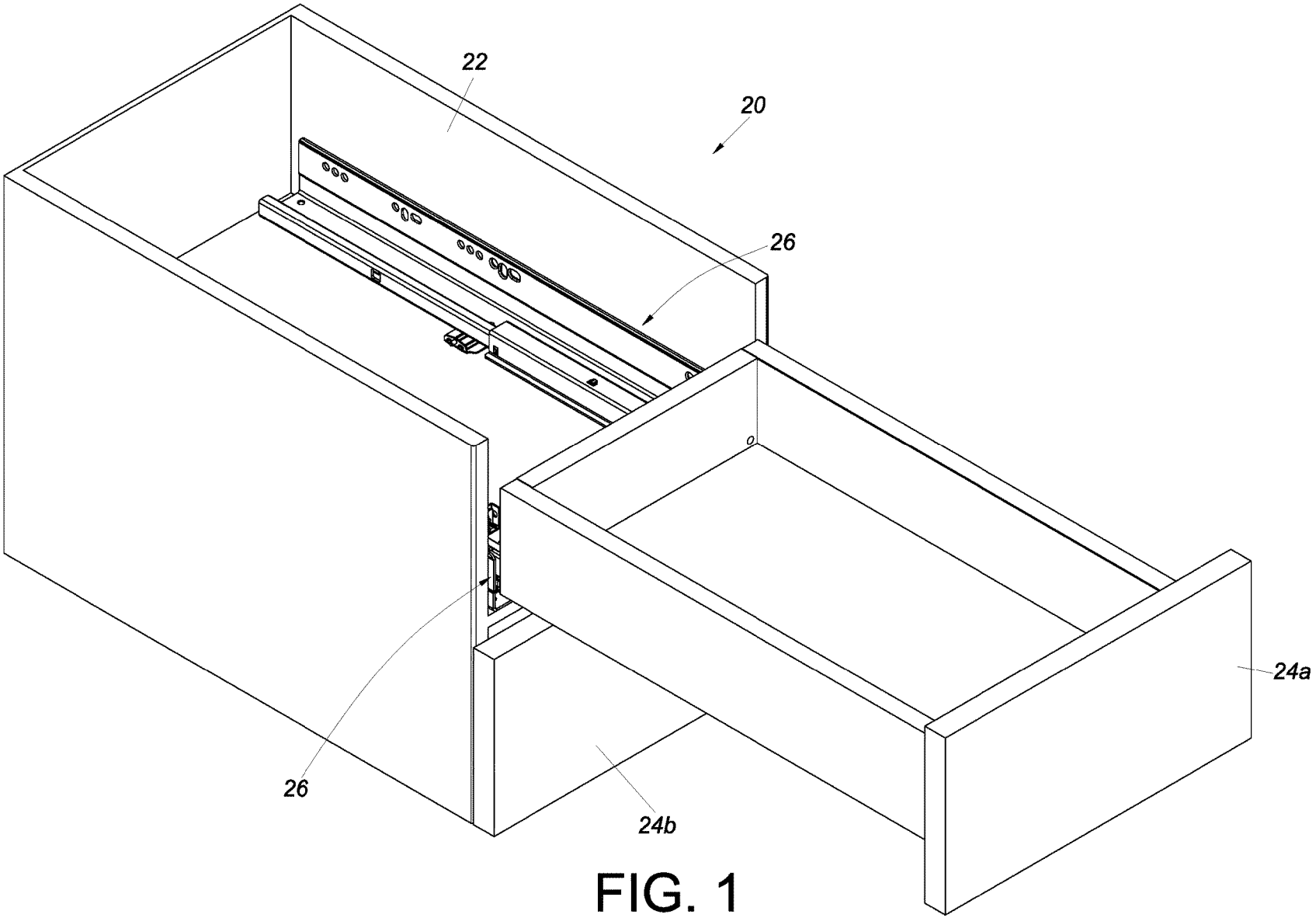
FIG. 1 is a perspective view of a piece of furniture in an embodiment of the present invention, wherein the furniture includes a first furniture part and two second furniture parts displaceable with respect to the first furniture part.

Referring to FIG. 1, a piece of furniture 20 includes a first furniture part 22 and at least one second furniture part. Here, two second furniture parts 24*a* and 24*b* are provided by way of example. Each second furniture part, such as the second furniture part 24*a*, can be displaced with respect to the first furniture part 22. Preferably, a pair of slide rail assemblies 26 are provided to facilitate displacement of the second furniture part 24*a* with respect to the first furniture part 22. The first furniture part 22 may be the body of a cabinet, and the two second furniture parts 24*a* and 24*b* may be drawers; the present invention has no limitation in this regard.

Figure 2:
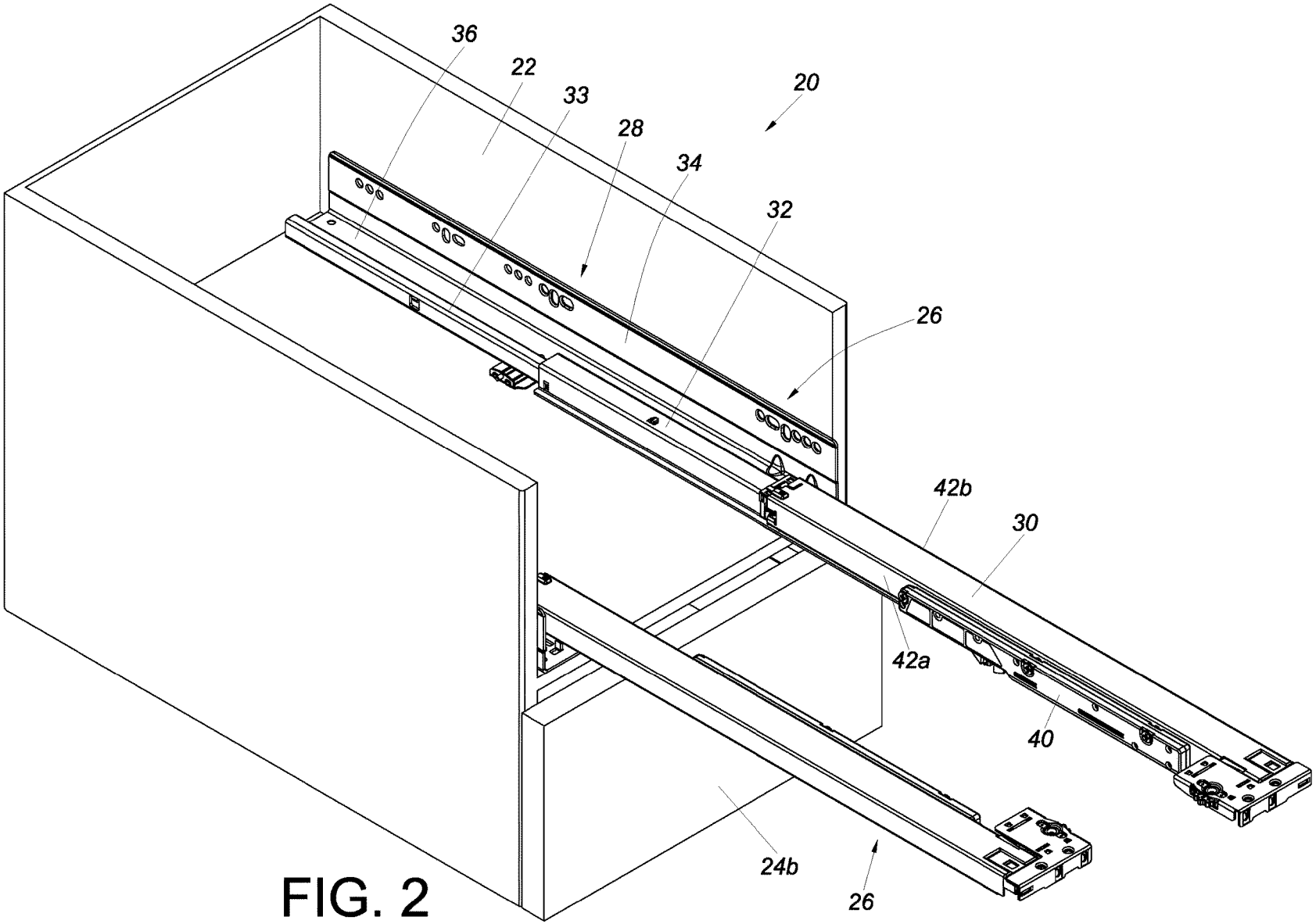
FIG. 2 is a perspective view of a first rail and a second rail, which can be viewed as the first furniture part and the second furniture part respectively in an embodiment of the present invention.
Figures 3, 4, 5:
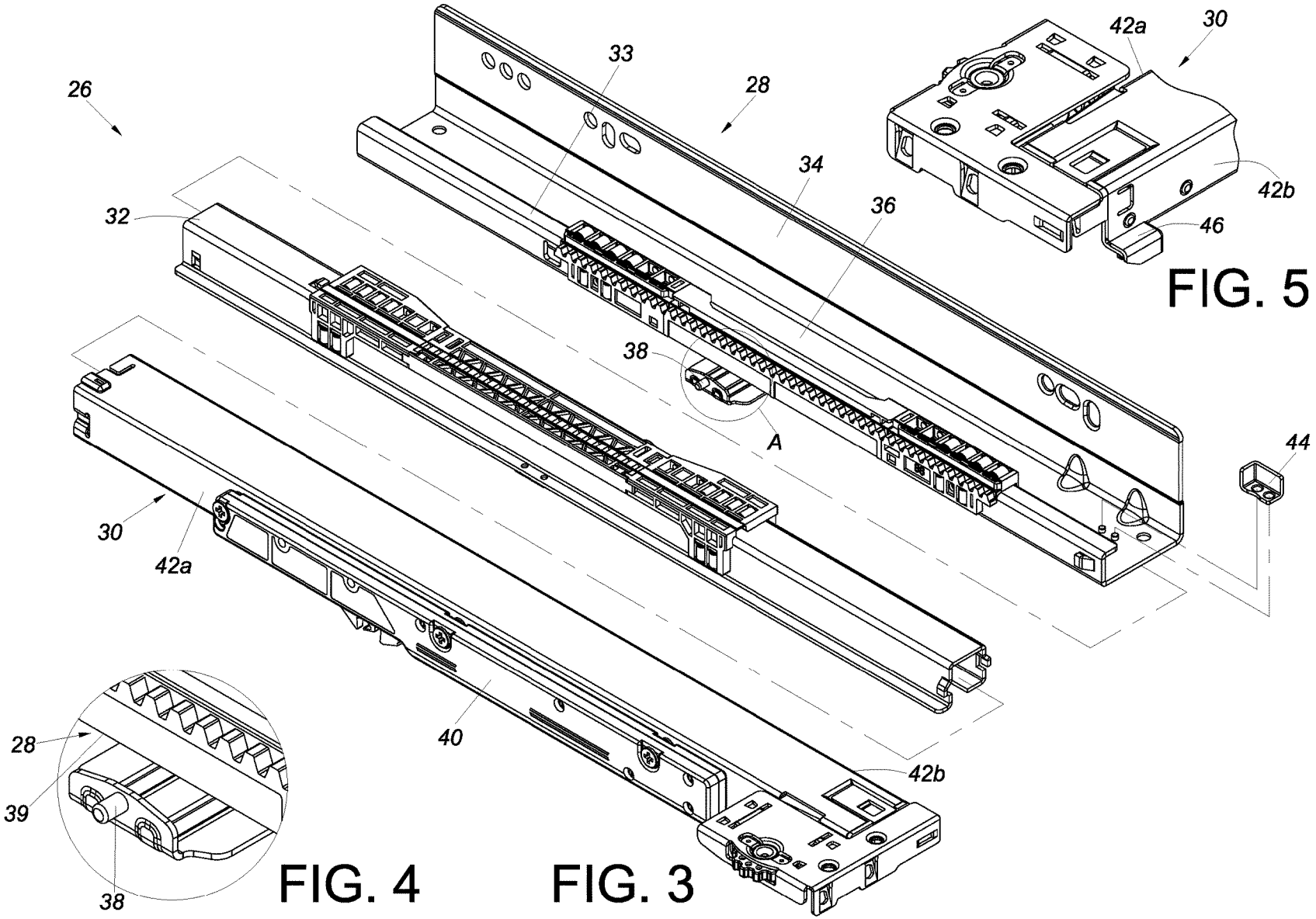
FIG. 3 is an exploded perspective view of a slide rail assembly in an embodiment of the present invention.
FIG. 4 is an enlarged view of the circled area A in FIG. 3.
FIG. 5 is a partial perspective view of the second rail of the slide rail assembly in an embodiment of the present invention, showing in particular that the second rail includes a position-limiting feature.

Referring to FIG. 2 and FIG. 3, each slide rail assembly 26 includes a first rail 28, a second rail 30 longitudinally displaceable with respect to the first rail 28, and preferably also a third rail 32 movably mounted between the first rail 28 and the second rail 30 to increase the distance by which the second rail 30 can be displaced with respect to the first rail 28. The first rails 28 are fixedly mounted on the first furniture part 22 and therefore can each be viewed as a part of the first furniture part 22. More specifically, each first rail 28 includes a track 33, a mounting sidewall 34, and an extension wall 36. The track 33 is configured to be mounted with the corresponding third rail 32. The mounting sidewall 34 is fixed (e.g., threadedly connected) to the first furniture part 22. The extension wall 36 is connected between the track 33 and the mounting sidewall 34. On the other hand, The second rails 30 are configured for carrying the second furniture part 24*a* and therefore can each be viewed as a part of the second furniture part 24*a*. As shown in FIG. 1, the second rails 30 allow the second furniture part 24*a* to be easily displaced from inside the first furniture part 22 to the outside and pushed back into the first furniture part 22.

As shown in FIG. 3, an engaging feature 38 is arranged at one of the first furniture part 22 (e.g., the first rail 28) and the second furniture part 24*a* (e.g., the second rail 30). Here, the engaging feature 38 is a fixed pin, is fixedly mounted on the first rail 28 at a position adjacent to a bottom portion 39 of the first rail 28, and extends in a lateral direction (see FIG. 4). In addition, a retracting mechanism 40 according to an embodiment of the present invention is applied to the furniture 20. The retracting mechanism 40 in this embodiment is mounted on a first side 42*a* of the second rail 30 by way of example. Preferably, a first position-limiting feature 44 is arranged at the first rail 28, and the second rail 30 includes a second position-limiting feature 46 (see FIG. 5) corresponding in position to the first position-limiting feature 44. Here, the second position-limiting feature 46 is arranged on a second side 42*b* of the second rail 30 (i.e., the opposite side of the first side 42*a*) by way of example. The first position-limiting feature 44 and the second position-limiting feature 46 are adjacent to the front ends of the first rail 28 and of the second rail 30 respectively and are shown in the drawings as projections or block-shaped elements by way of example.

Figure 6:
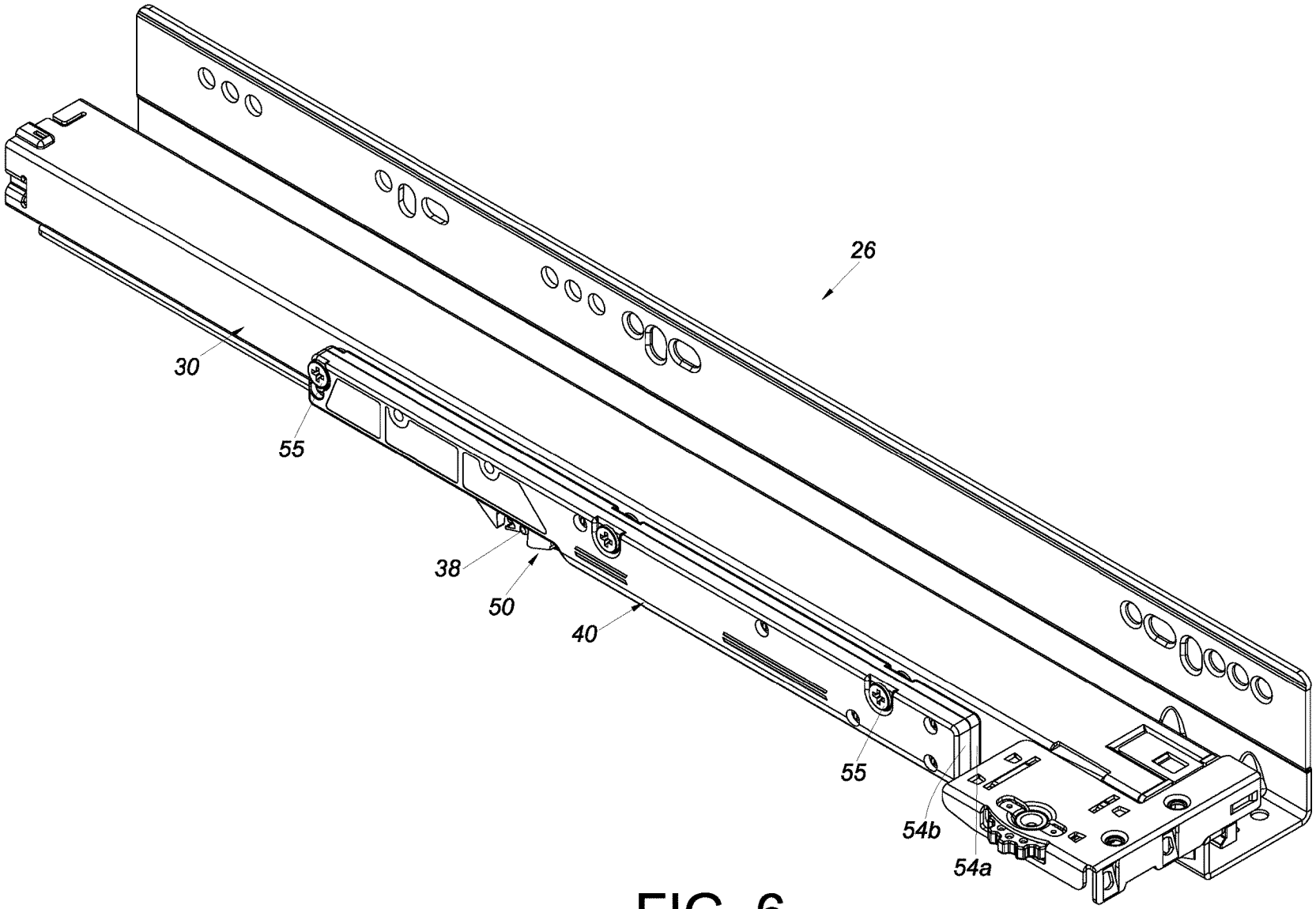
FIG. 6 is an assembled perspective view of the slide rail assembly in an embodiment of the present invention.
Figure 7:
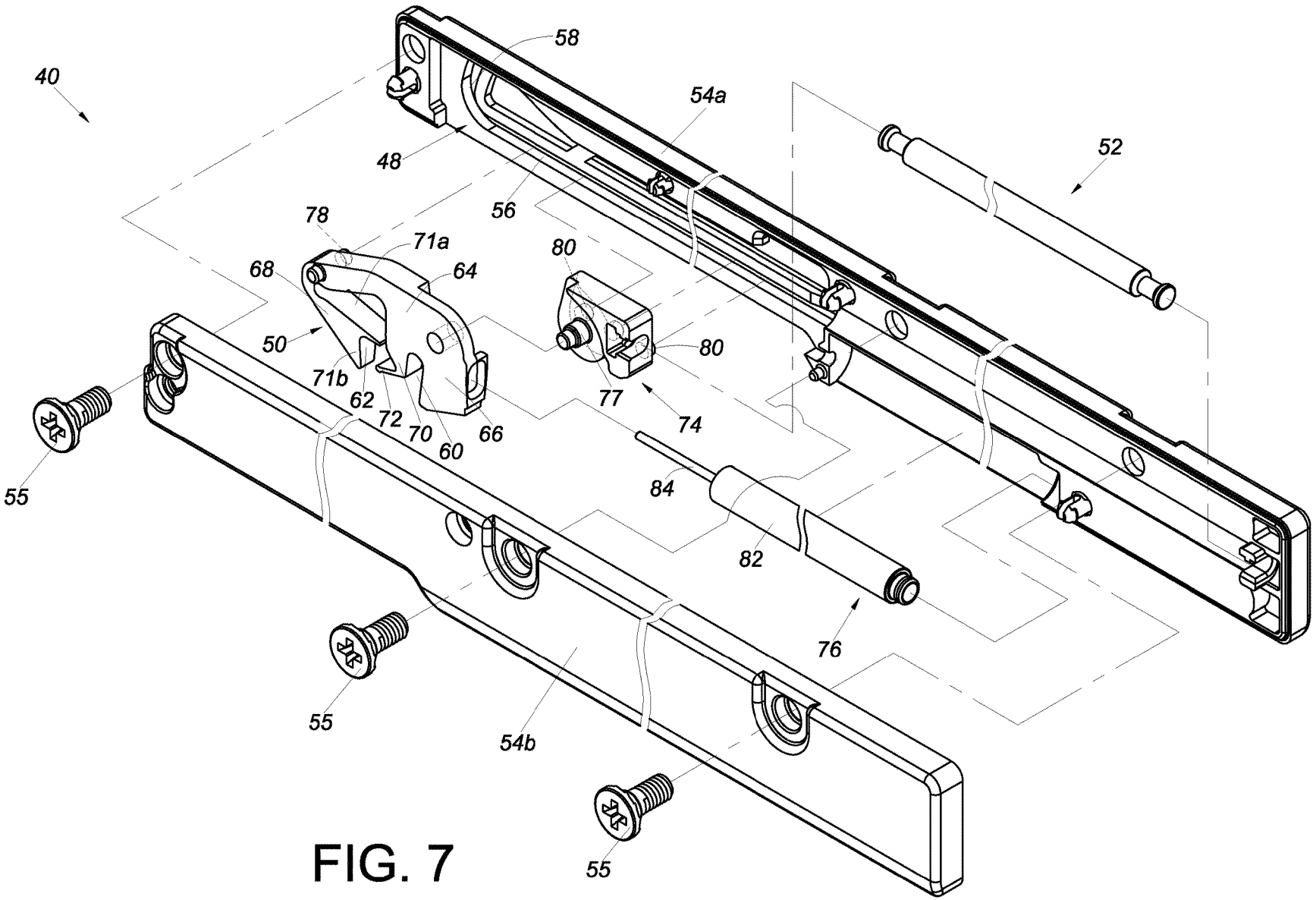
FIG. 7 is an exploded perspective view of the retracting mechanism in an embodiment of the present invention.

As shown in FIG. 6 and FIG. 7, the retracting mechanism 40 includes a guiding structure 48, a catch member 50, a resilient member 52, and preferably also at least one housing for protecting the guiding structure 48, the catch member 50, and the resilient member 52. Here, by way of example, the at least one housing is implemented as a first housing 54*a* and a second housing 54*b* matching the first housing 54*a*. The first housing 54*a* and the second housing 54*b* are mounted to the second rail 30 via a plurality of connecting members 55.

The guiding structure 48 is located at the at least one housing. For example, the guiding structure 48 is formed at the first housing 54*a*. The guiding structure 48 includes a first guiding portion 56 and a second guiding portion 58 adjacent to the first guiding portion 56. Preferably, the second guiding portion 58 is in communication with the first guiding portion 56 and is offset from the first guiding portion 56 by an angle. More specifically, the first guiding portion 56 has a predetermined longitudinal length, and the second guiding portion 58 is not arranged longitudinally. Here, by way of example, the first guiding portion 56 and the second guiding portion 58 are holes or grooves that are in communication with each other.

The catch member 50 is configured to be displaced between the first guiding portion 56 and the second guiding portion 58 and includes a first feature 60 and a second feature 62. Preferably, the catch member 50 includes a main body 64, a first extension portion 66, a second extension portion 68, and a third extension portion 70. The first extension portion 66, the second extension portion 68, and the third extension portion 70 are connected to the main body 64, with the third extension portion 70 lying between the first extension portion 66 and the second extension portion 68. Preferably, the first feature 60 is located between the first extension portion 66 and the third extension portion 70. For example, the first extension portion 66 and the third extension portion 70 jointly define a holding hook as the first feature 60. The second feature 62, on the other hand, is located at the second extension portion 68. Preferably, the second extension portion 68 is made of a flexible material (e.g., plastic) and includes a first section 71*a* and a second section 71*b* bent with respect to the first section 71*a*, and the first section 71*a* and the second section 71*b* form an engaging hook as the second feature 62. The engaging hook is preferably formed at a position adjacent to an end portion of the second extension portion 68. The retracting mechanism 40 preferably further includes a resilient leg 72 connected to the third extension portion 70. The resilient leg 72 is bent with respect to the third extension portion 70 and is adjacent to or faces the second extension portion 68. Here, the resilient leg 72 is made of a flexible material (e.g., plastic) by way of example.

Preferably, the retracting mechanism 40 further includes a base 74 and a cushioning device 76.

Preferably, the base 74 is pivotally connected to the catch member 50 through a shaft portion 77, and the resilient member 52 (e.g., a spring) is mounted between the first housing 54*a* and the base 74 (or the catch member 50). Preferably, the catch member 50 can be displaced between the first guiding portion 56 and the second guiding portion 58 via a first guiding member 78, and the base 74 can be displaced in the first guiding portion 56 via at least one second guiding member 80. The cushioning device 76 is configured for cushioning and includes a cylinder 82 and a rod 84. The cylinder 82 contains a cushioning medium. The rod 84 stays extended out of the cylinder 82. As the configuration of the cushioning device 76 is well known in the art, further description is omitted herein for the sake of brevity. Preferably, the cylinder 82 is mounted on the first housing 54*a*, and the rod 84 faces the catch member 50 (or the base 74).

Figure 8:
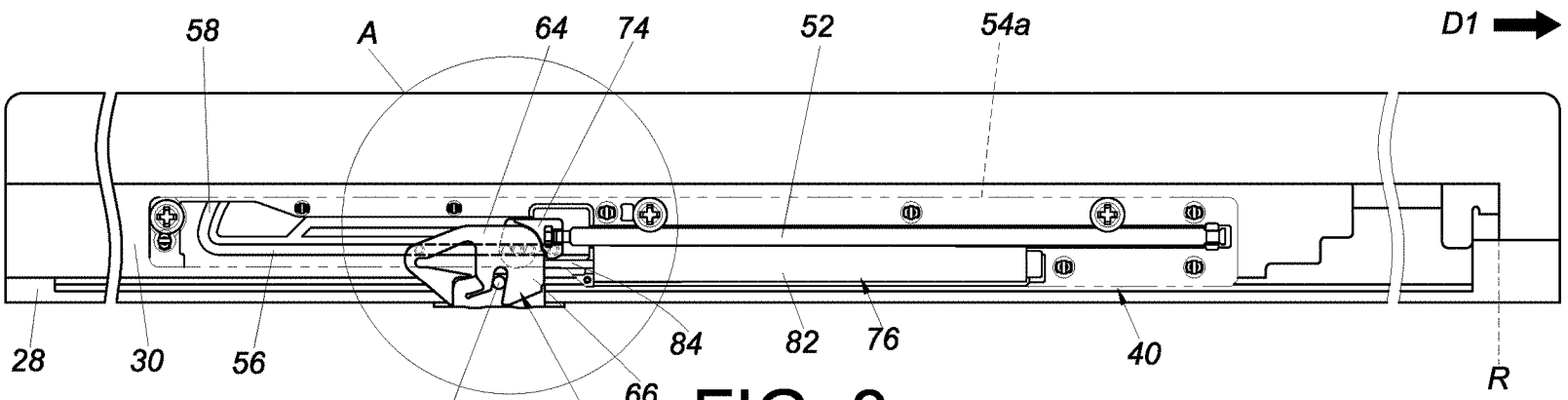
FIG. 8 shows that a second furniture part is at a retracted position with respect to the first furniture part, and that a first feature of the catch member of the retracting mechanism catches an engaging feature in accordance with an embodiment of the present invention.
Figure 9:
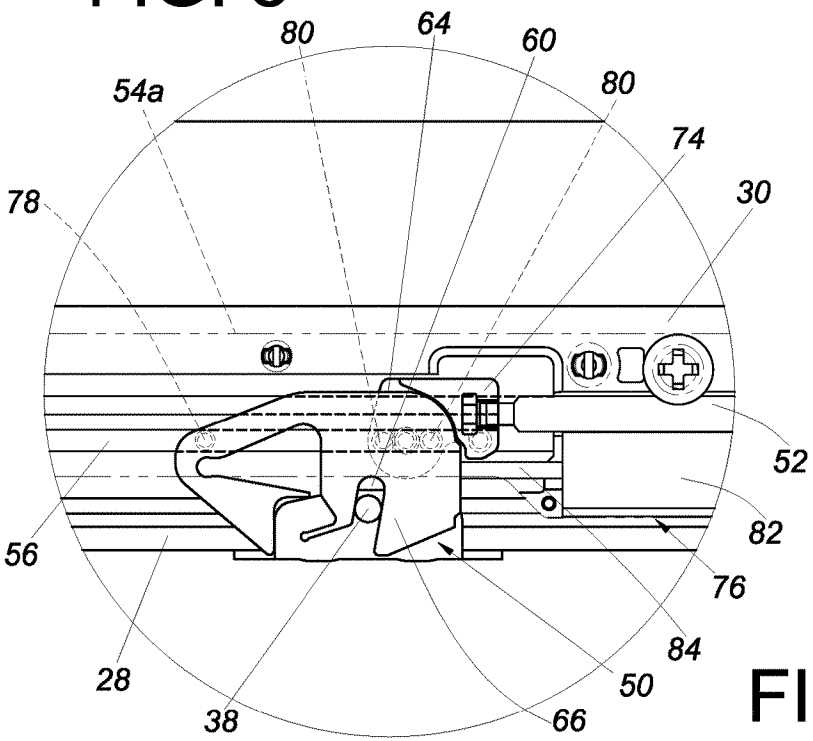
FIG. 9 is an enlarged view of the circled area A in FIG. 8.

Referring to FIG. 8 and FIG. 9, the engaging feature 38 is arranged at the first furniture part 22 (e.g., a cabinet body or the first rail 28) while the catch member 50 is located at the second furniture part 24*a* (e.g., a drawer or the second rail 30). Hereinafter, the first rail 28 and the second rail 30 are taken respectively as the first furniture part 22 and the second furniture part 24*a* by way of example. When the second rail 30 is at a retracted position R with respect to the first rail 28, and the catch member 50 is at the first guiding portion 56, the first feature 60 of the catch member 50 catches the engaging feature 38. On the other hand, the first guiding member 78 of the catch member 50 and the at least one second guiding member 80 of the base 74 extend into the first guiding portion 56, and the resilient member 52 is in a state in which it pre-stores an initial driving force. The rod 84 of the cushioning device 76 in this state is retracted with respect to the cylinder 82 and is pressed against one of the catch member 50 and the base 74 (e.g., against the main body 64 and/or a lateral portion of the first extension portion 66 of the catch member 50, the present invention having no limitation in this regard).

Figure 10:
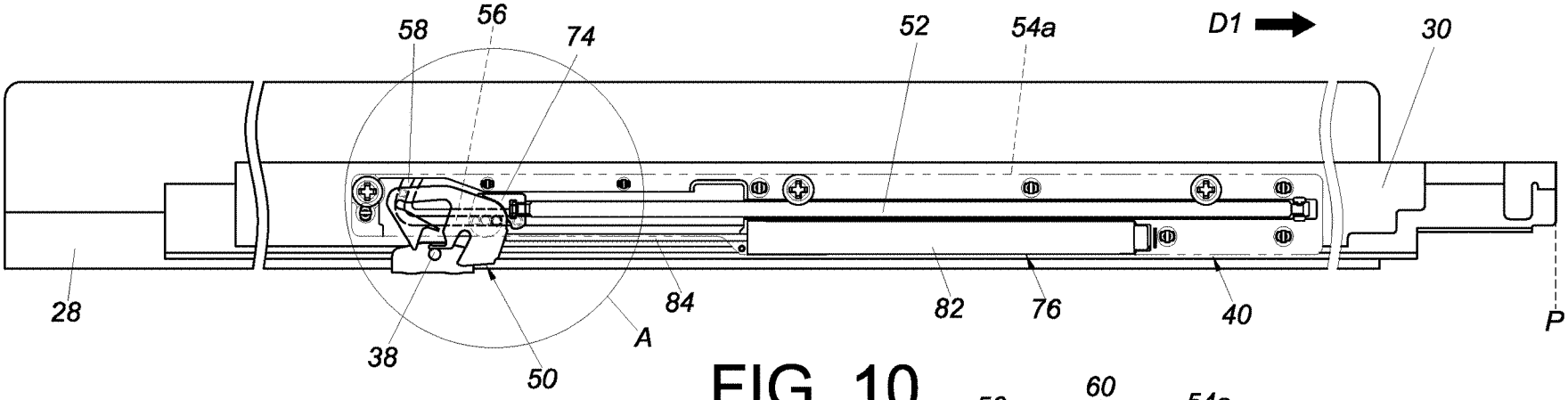
FIG. 10 shows that the second furniture part is displaced with respect to the first furniture part in an opening direction, and that the first feature of the catch member is disengaged from the engaging feature in accordance with an embodiment of the present invention.
Figure 11:
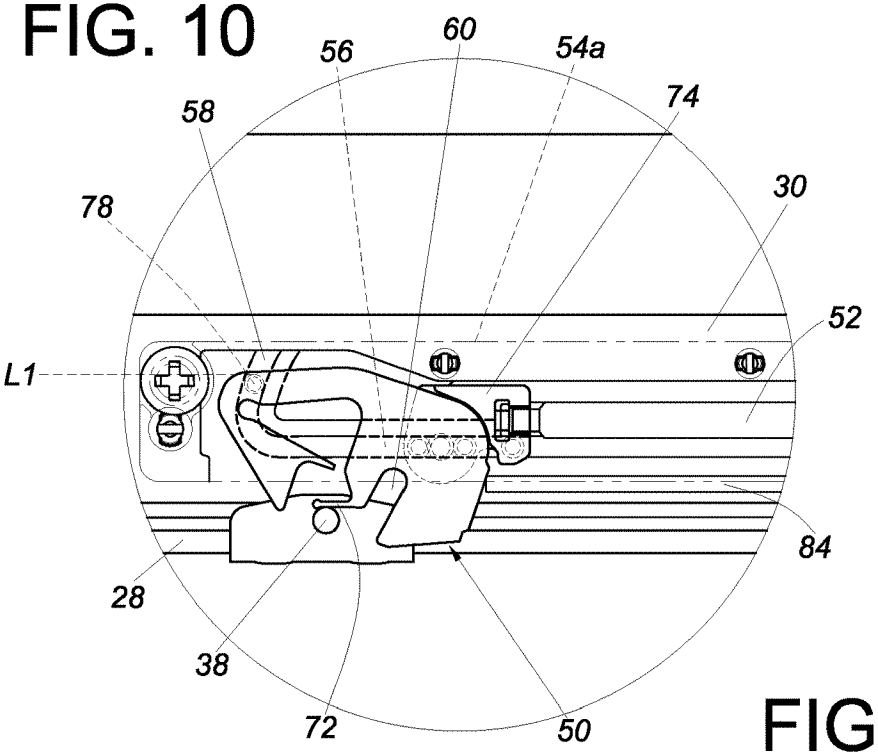
FIG. 11 is an enlarged view of the circled area A in FIG. 10.

Referring to FIG. 10 and FIG. 11 in conjunction with FIG. 8, when under normal conditions the second rail 30 is being displaced in an opening direction D1 with respect to the first rail 28 from the retracted position R to a predetermined position P, with the engaging feature 38 caught by the first feature 60 of the catch member 50, the housing (e.g., the first housing 54*a*) of the retracting mechanism 40 is displaced along with the second rail 30 in the opening direction D1 such that the catch member 50 is tilted with respect to the base 74 by an angle and is displaced from the first guiding portion 56 into temporary engagement with the second guiding portion 58. In other words, the second guiding portion 58 causes the catch member 50 to tilt through the aforesaid angle, thereby disengaging the first feature 60 from the engaging feature 38. Also, the resilient member 52 becomes engaged with the second guiding portion 58 in response to the displacement of the catch member 50 and temporarily stores a driving force for retraction. More specifically, the first guiding member 78 of the catch member 50 enters the second guiding portion 58 from the first guiding portion 56, and the rod 84 of the cushioning device 76 extends out of the cylinder 82 in order for the cushioning device 76 to store cushioning energy.

Figure 13:
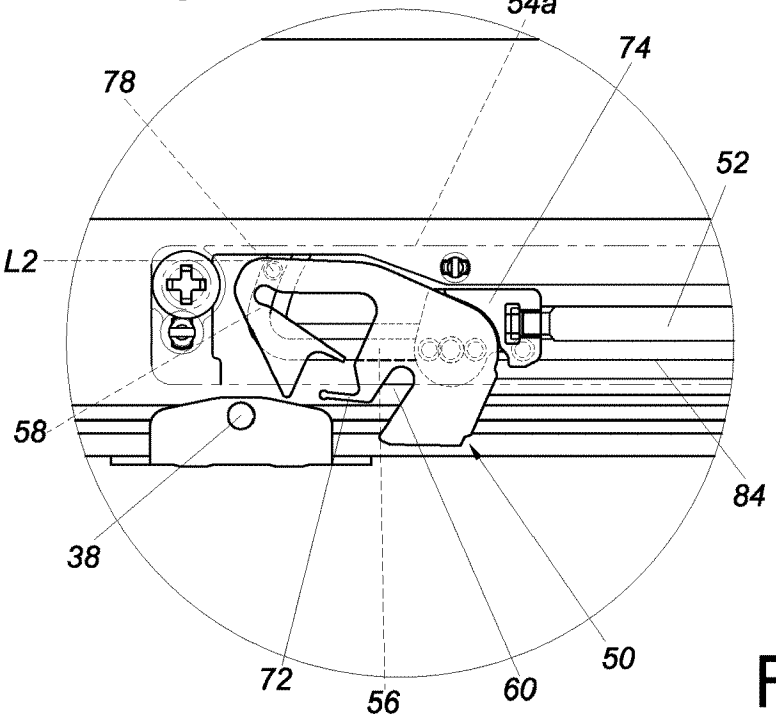
FIG. 13 is an enlarged view of the circled area A in FIG. 12.
Figure 14:
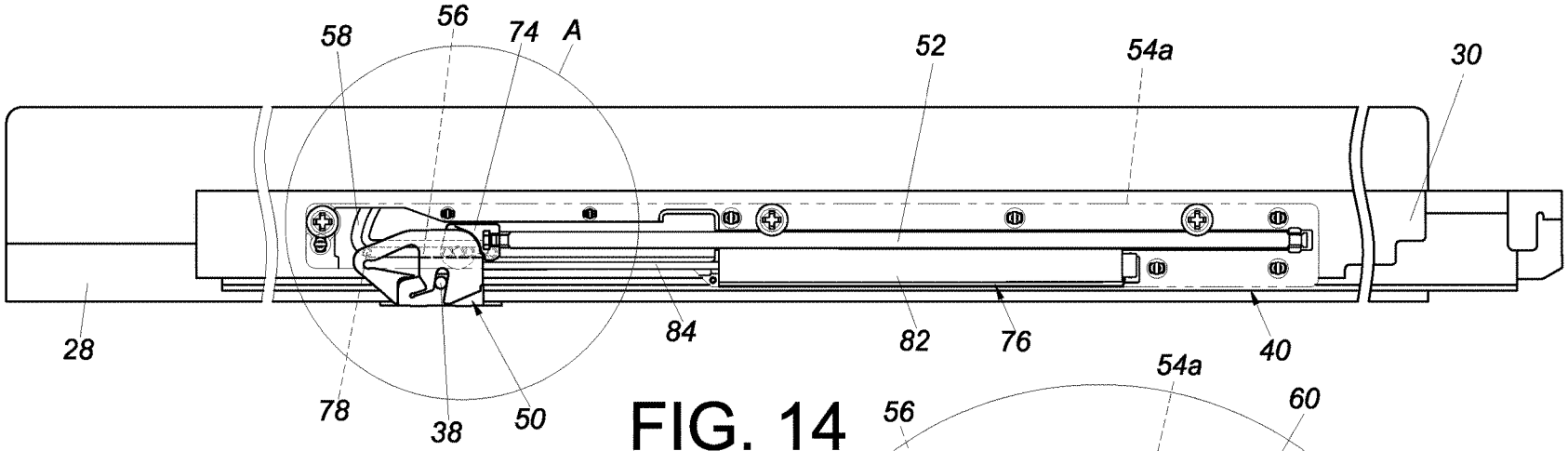
FIG. 14 shows that the second furniture part is displaced with respect to the first furniture part in the retracting direction, and that the first feature of the catch member catches the engaging feature in accordance with an embodiment of the present invention.
Figure 15:
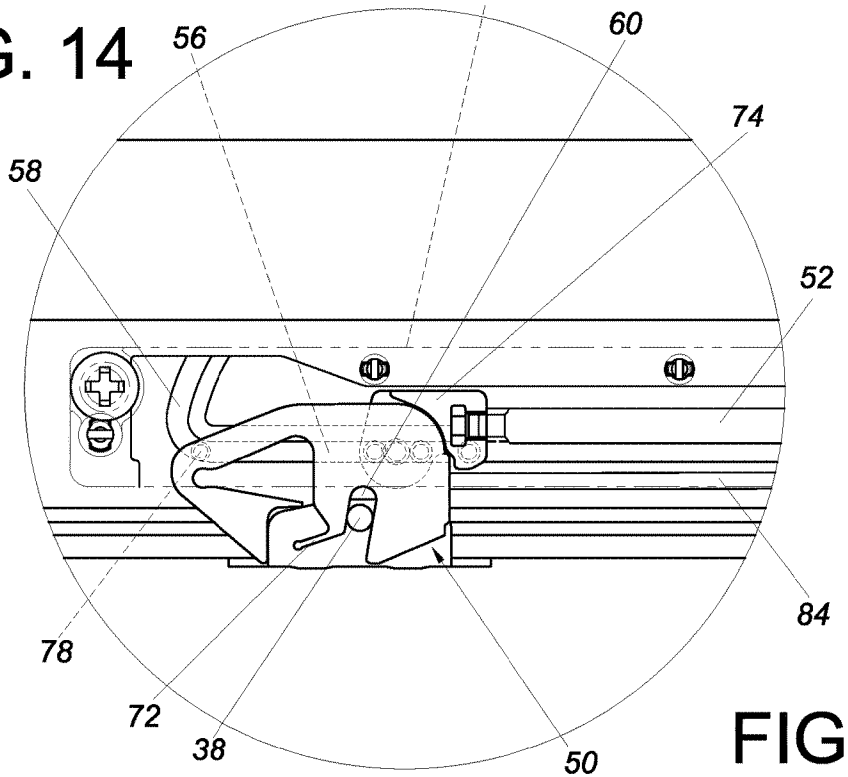
FIG. 15 is an enlarged view of the circled area A in FIG. 14.

In the course in which the second rail 30 is displaced in the opening direction D1 with respect to the first rail 28 from the retracted position R to the predetermined position P, the resilient leg 72 works directly with the engaging feature 38. For example, the resilient leg 72 is brought into direct contact with the engaging feature 38 to help tilt and displace the catch member 50 from the first guiding portion 56 to the second guiding portion 58. More specifically, the resilient leg 72 in direct contact with the engaging feature 38 applies a force to the catch member 50 to drive the first guiding member 78 of the catch member 50 into the second guiding portion 58, thus tilting the catch member 50 from a first tilted position L1 to a second tilted position L2 (see FIG. 13), which is closer to an end of the second guiding portion 58 than the first tilted position L2.

Referring to FIG. 12 through FIG. 15, when the second rail 30 is retracted in a retracting direction D2 with respect to the first rail 28 from an opened position E or the predetermined position P and comes to the last stage of the retracting process, the first feature 60 of the catch member 50 catches the engaging feature 38 again such that the catch member 50 is disengaged from the second guiding portion 58 and returns to the first guiding portion 56. The resilient member 52, therefore, releases the driving force for retraction, which driving force acts on and helps retract the second rail 30 in the retracting direction D2 with respect to the first rail 28 in the last stage of the retracting process until the second rail 30 reaches the retracted position R (see FIG. 8) with respect to the first rail 28; thus, the retracting mechanism 40 carries out the so-called self-closing function. The cushioning device 76, on the other hand, cushions (i.e., reduces) the driving force acting on the second rail 30. In other words, the cushioning device 76 produces a cushioning effect in the last stage of the retracting process of the second rail 30, during which the second rail 30 is displaced to the retracted position R with respect to the first rail 28. Moreover, the first guiding member 78 returns from the second guiding portion 58 to the first guiding portion 56 in response to the tilting action of the catch member 50.

Figure 12:
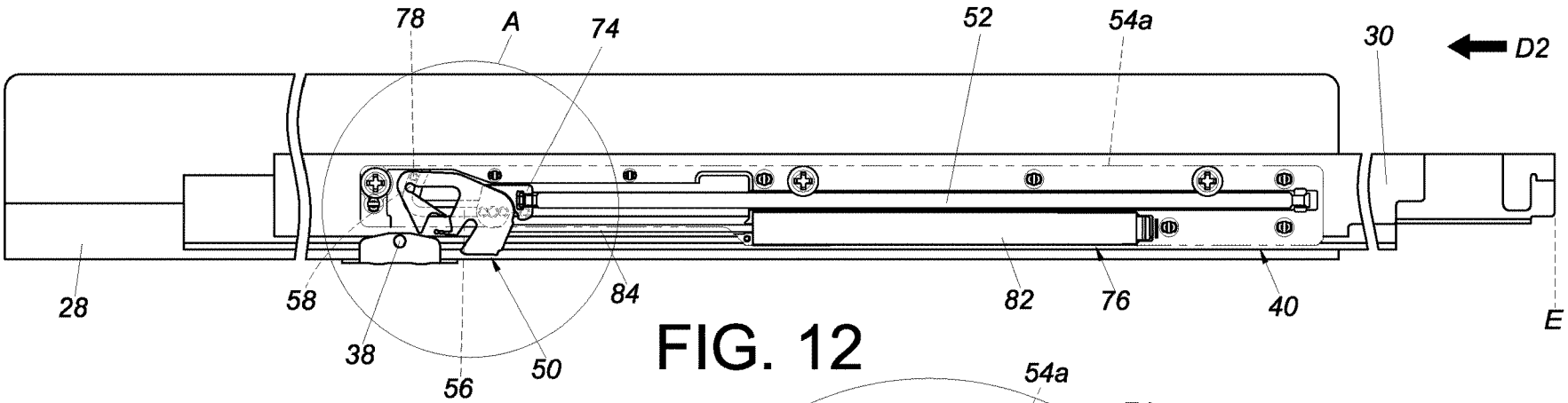
FIG. 12 shows that the second furniture part is displaced with respect to the first furniture part in a retracting direction, with the first feature of the catch member facing the engaging feature in accordance with an embodiment of the present invention.
Figure 16:
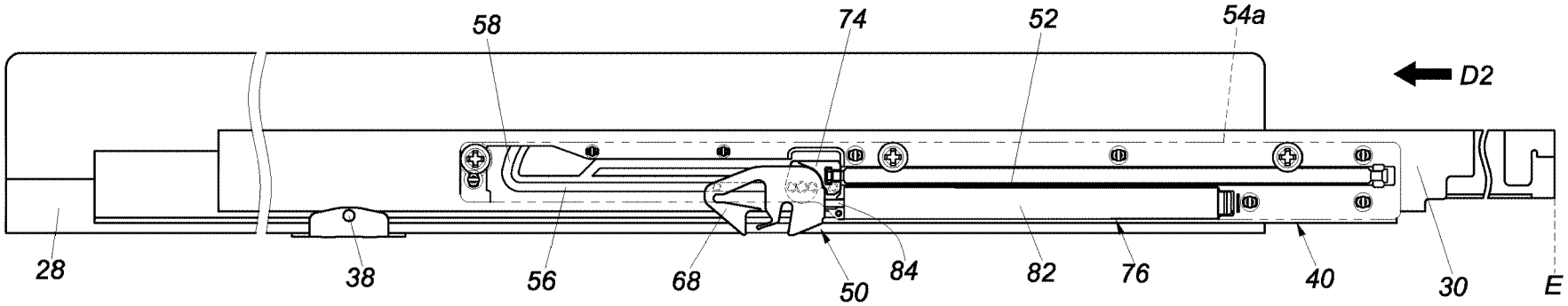
FIG. 16 shows that the second furniture part is displaced with respect to the first furniture part in the retracting direction in accordance with an embodiment of the present invention.
Figure 17:
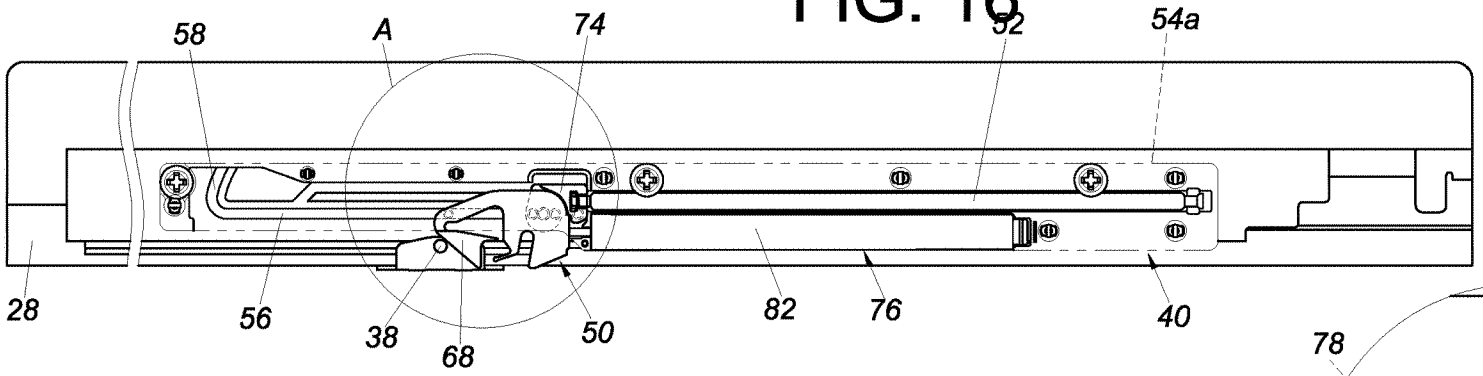
FIG. 17 shows that the second furniture part is displaced with respect to the first furniture part in the retracting direction, and that an extension portion of the catch member is in contact with the engaging feature in accordance with an embodiment of the present invention.
Figure 18:
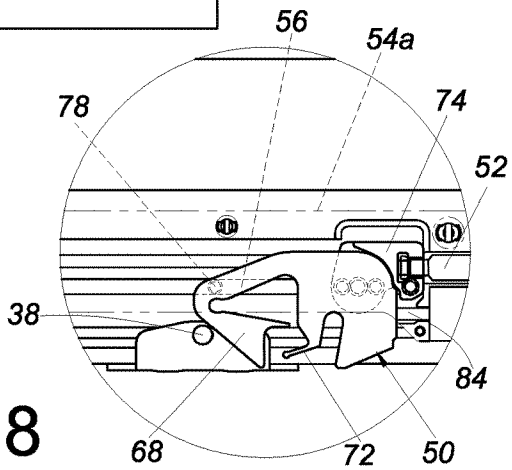
FIG. 18 is an enlarged view of the circled area A in FIG. 17.
Figure 19:
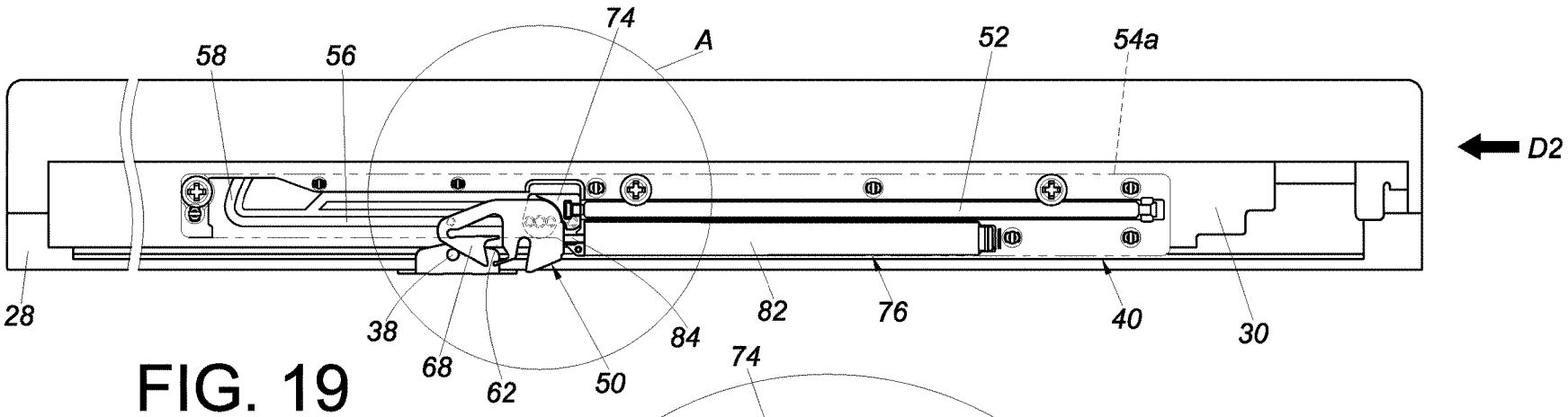
FIG. 19 shows that the second furniture part is displaced with respect to the first furniture part in the retracting direction, and that the extension portion of the catch member is not only in contact with but also flexibly deformed by the engaging feature in accordance with an embodiment of the present invention.
Figure 20:
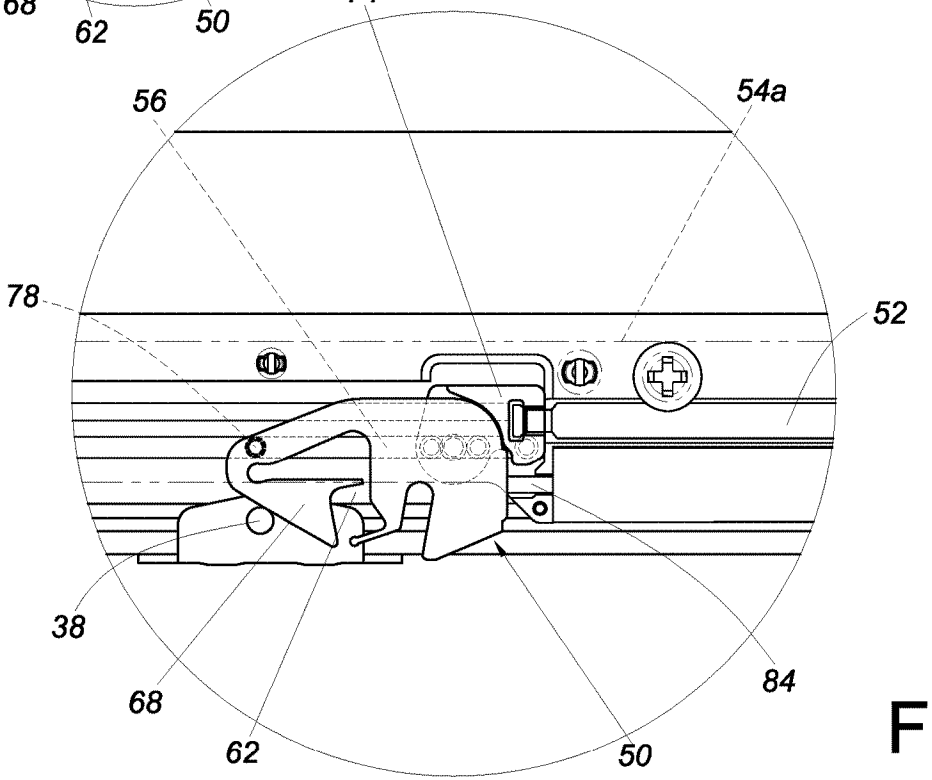
FIG. 20 is an enlarged view of the circled area A in FIG. 19.

Referring to FIG. 16 and FIG. 17 for an abnormal condition in contrast to the condition depicted in FIG. 12, the second rail 30 is at the opened position E (or the predetermined position P) with respect to the first rail 28, but the catch member 50 is disengaged from the second guiding portion 58 due to the intervention of an external force (or an inadvertently applied force) and ends up at the first guiding portion 56 such that the resilient member 52 cannot store the driving force for retraction. When the second rail 30 is retracted in the retracting direction D2 with respect to the first rail 28 under this condition, the second extension portion 68 of the catch member 50 will come into contact with the engaging feature 38 (see FIG. 18).

Referring to FIG. 19 through FIG. 22, when the second rail 30 is further retracted in the retracting direction D2 with respect to the first rail 28, the second extension portion 68 of the catch member 50 is pushed by the engaging feature 38 and therefore enters a forced state from the normal state, generating a flexible force that enables the second extension portion 68 to move past the engaging feature 38. Once moving past the engaging feature 38, the second extension portion 68 releases the flexible force and returns to the normal state; in consequence, the engaging feature 38 is caught by the second feature 62 of the catch member 50.

Figure 21:
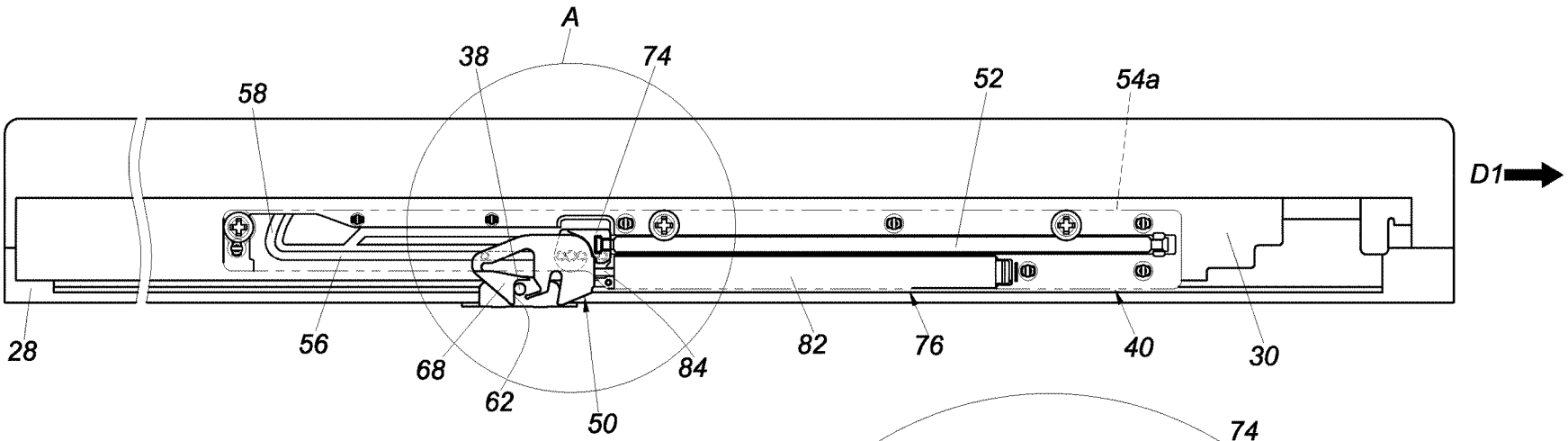
FIG. 21 shows that the engaging feature is caught by a second feature of the catch member, and that the second furniture part is displaced with respect to the first furniture part in the opening direction in accordance with an embodiment of the present invention.
Figure 22:
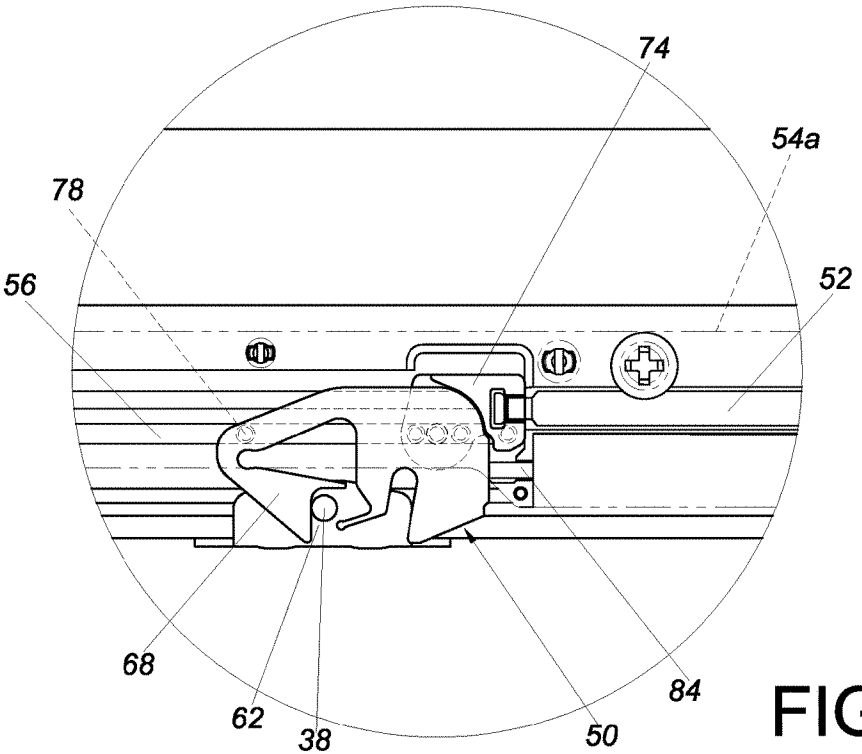
FIG. 22 is an enlarged view of the circled area A in FIG. 21.
Figure 23:
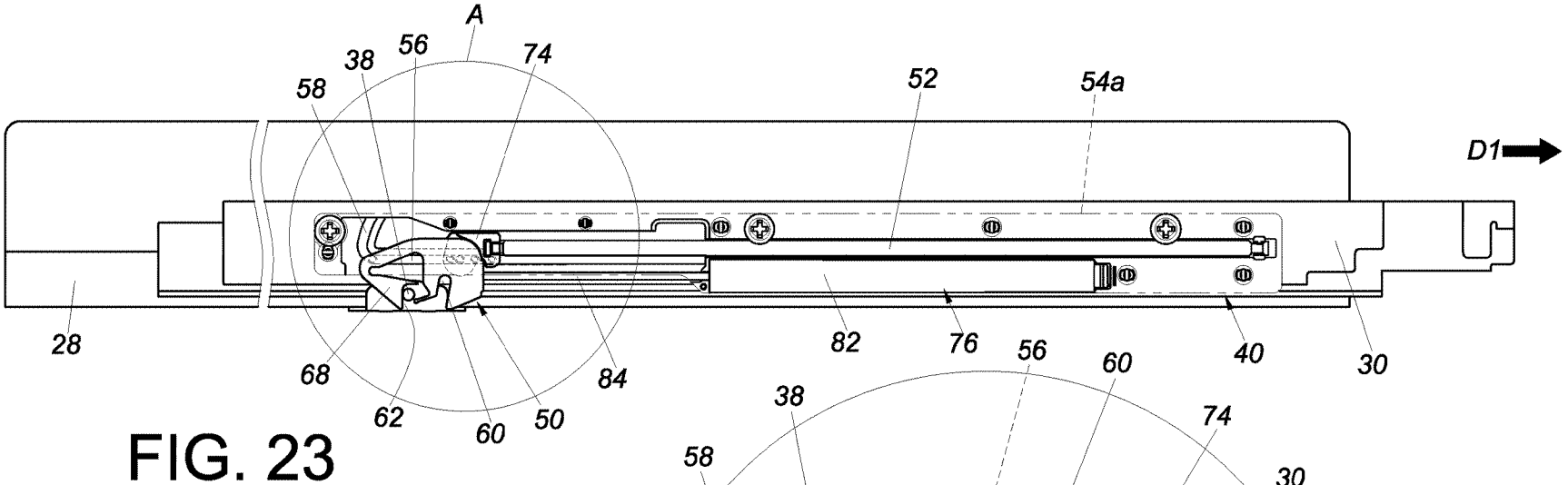
FIG. 23 shows that, with the engaging feature caught by the second feature of the catch member, the second furniture part is displaced with respect to the first furniture part in the opening direction in accordance with an embodiment of the present invention.
Figure 24:
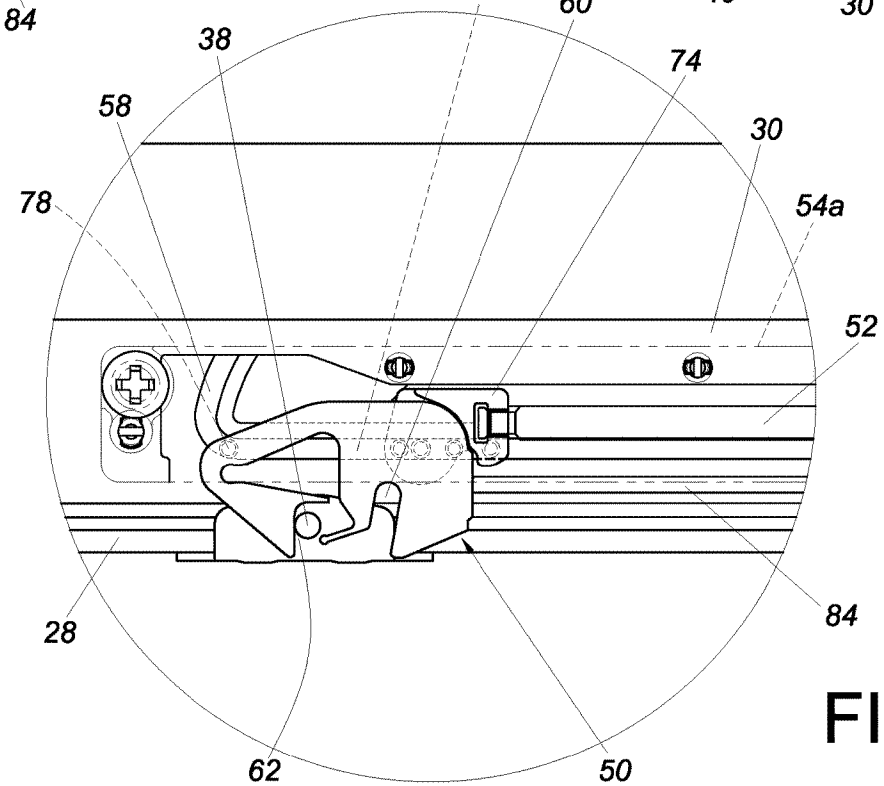
FIG. 24 is an enlarged view of the circled area A in FIG. 23.

After the second feature 62 of the catch member 50 catches the engaging feature 38, referring to FIG. 23 and FIG. 24 in conjunction with FIG. 21, the operator may displace the second rail 30 in the opening direction D1 with respect to the first rail 28 to bring the catch member 50 (or the first guiding member 78) from the first guiding portion 56 toward the second guiding portion 58 gradually. On the other hand, the resilient member 52 accumulates the driving force for retraction, and the rod 84 of the cushioning device 76 gradually extends out of the cylinder 82.

Figure 25:
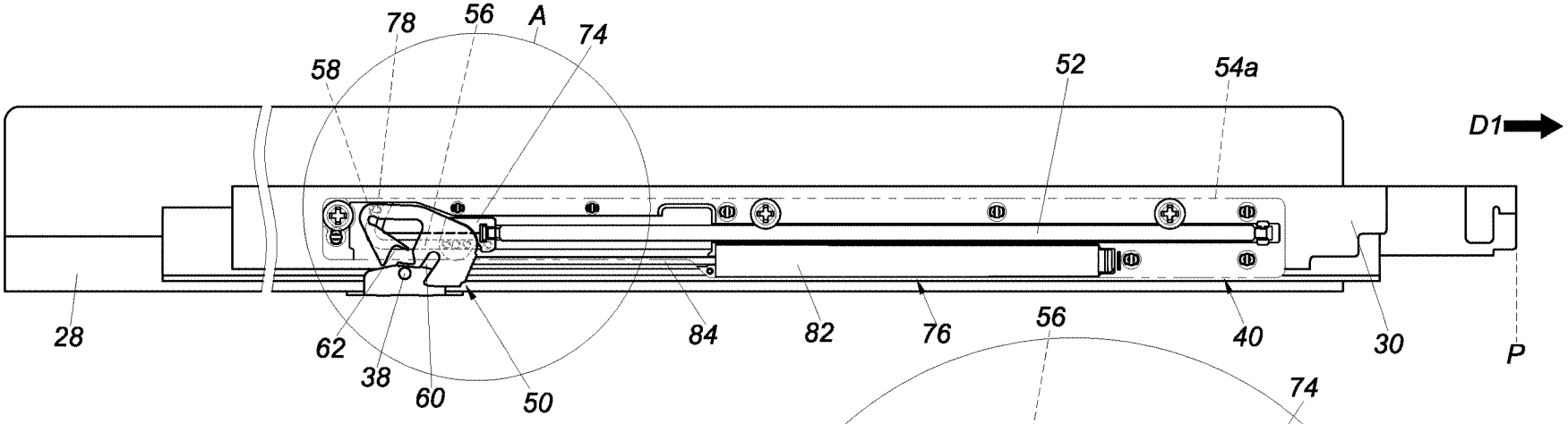
FIG. 25 shows that the second furniture part is displaced with respect to the first furniture part in the opening direction, and that the second feature of the catch member is disengaged from the engaging feature in accordance with an embodiment of the present invention.
Figure 26:
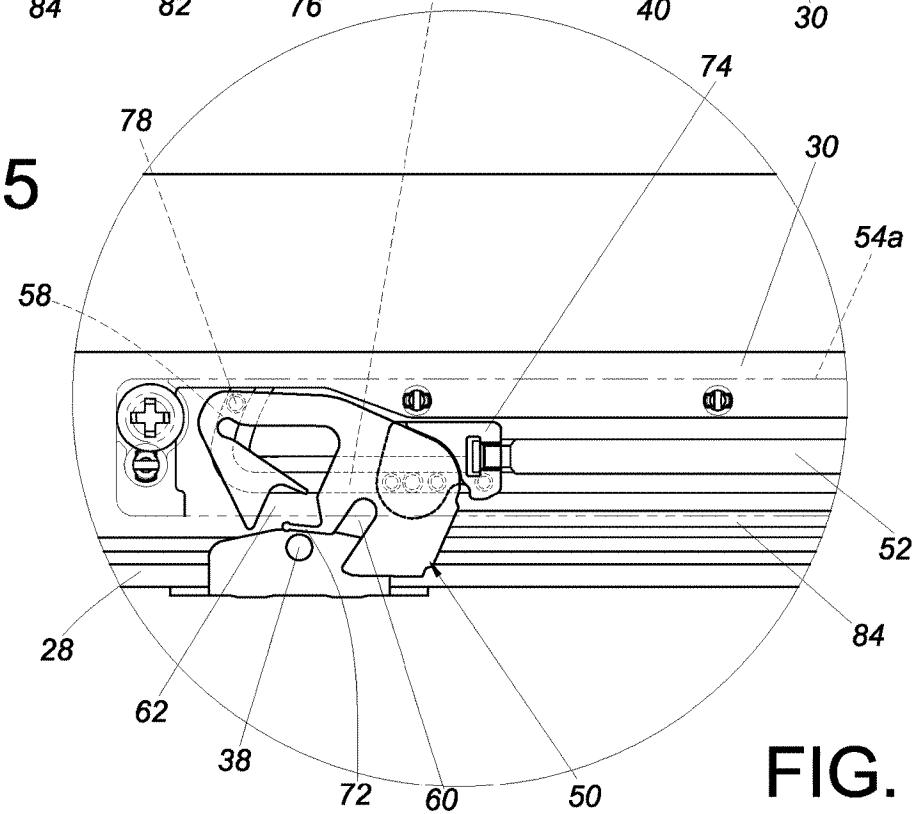
FIG. 26 is an enlarged view of the circled area A in FIG. 25.

Referring to FIG. 25 and FIG. 26 in conjunction with FIG. 23, the operator may further displace the second rail 30 in the opening direction D1 with respect to the first rail 28 to the predetermined position P so that the catch member 50 (or the first guiding member 78) is tilted with respect to the base 74 by an angle and is thus displaced from the first guiding portion 56 into temporary engagement with the second guiding portion 58. That is to say, the second guiding portion 58 will cause the catch member 50 to tilt through the aforesaid angle, thereby disengaging the second feature 62 from the engaging feature 38. Also, the resilient member 52 will respond to the engagement between the catch member 50 and the second guiding portion 58 by temporarily storing the driving force for retraction, and the rod 84 of the cushioning device 76 will extend out of the cylinder 82 to the greatest extent. Preferably, in the course in which the second rail 30 is displaced in the opening direction D1 with respect to the first rail 28, the resilient leg 72 works directly with the engaging feature 38. For example, the resilient leg 72 is in direct contact with the engaging feature 38 to help tilt and displace the catch member 50 from the first guiding portion 56 to the second guiding portion 58.

It can be known from the above that the second feature 62 of the catch member 50 enables the retracting mechanism 40 to return from the abnormal condition (or a failure condition) to a normal condition so that, when the second rail 30 is in the last stage of displacement in the retracting direction D2 (i.e., the opposite direction of the opening direction D1) with respect to the first rail 28, the first feature 60 of the catch member 50 will catch the engaging feature 38 again (which process has been described above with reference to FIG. 12 and FIG. 14 and therefore will not be repeated).

Figure 27:
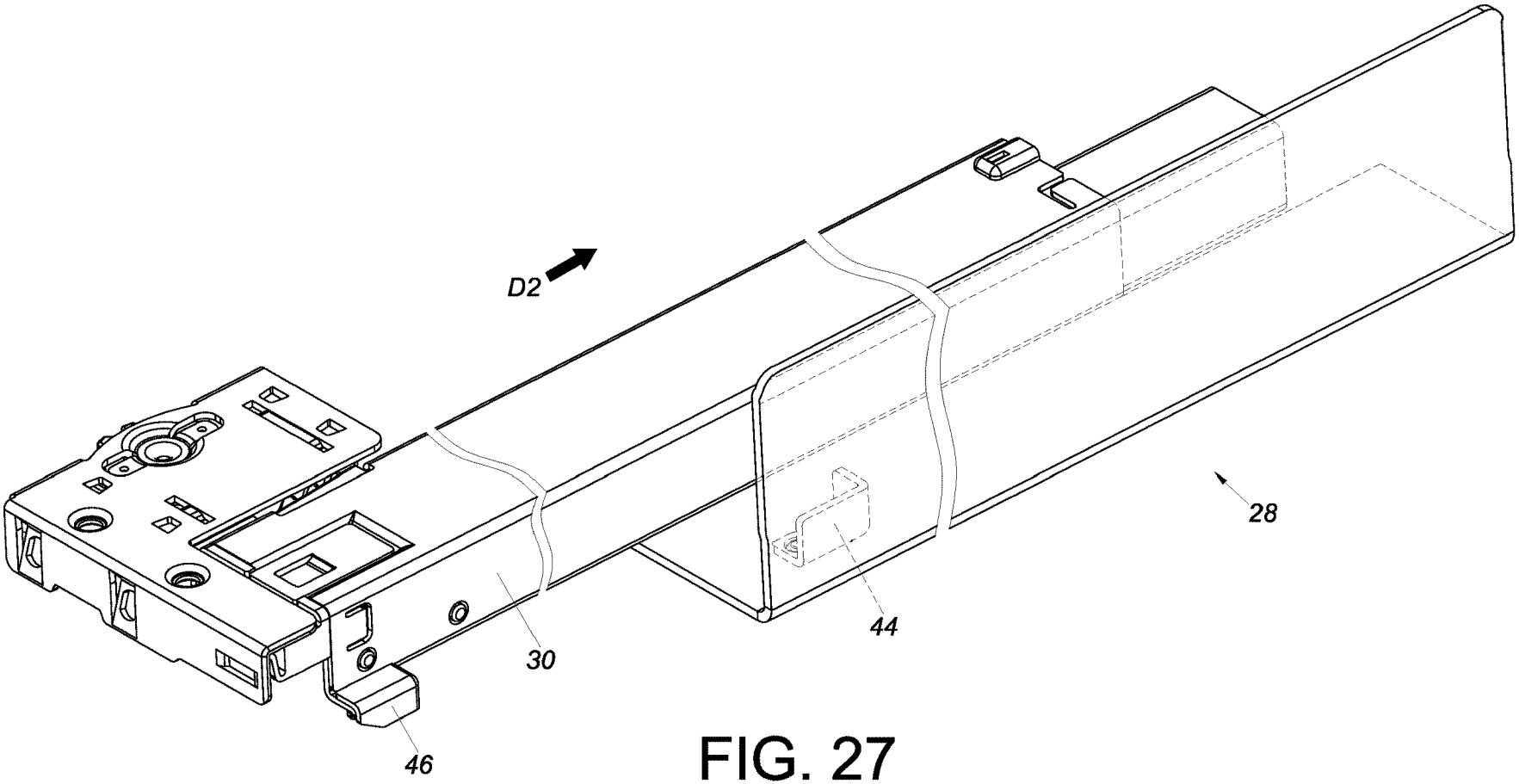
FIG. 27 is a perspective view showing in particular the corresponding position-limiting features of the first furniture part and of a second furniture part in an embodiment of the present invention, with the second furniture part at an opened position with respect to the first furniture part.
Figure 28:
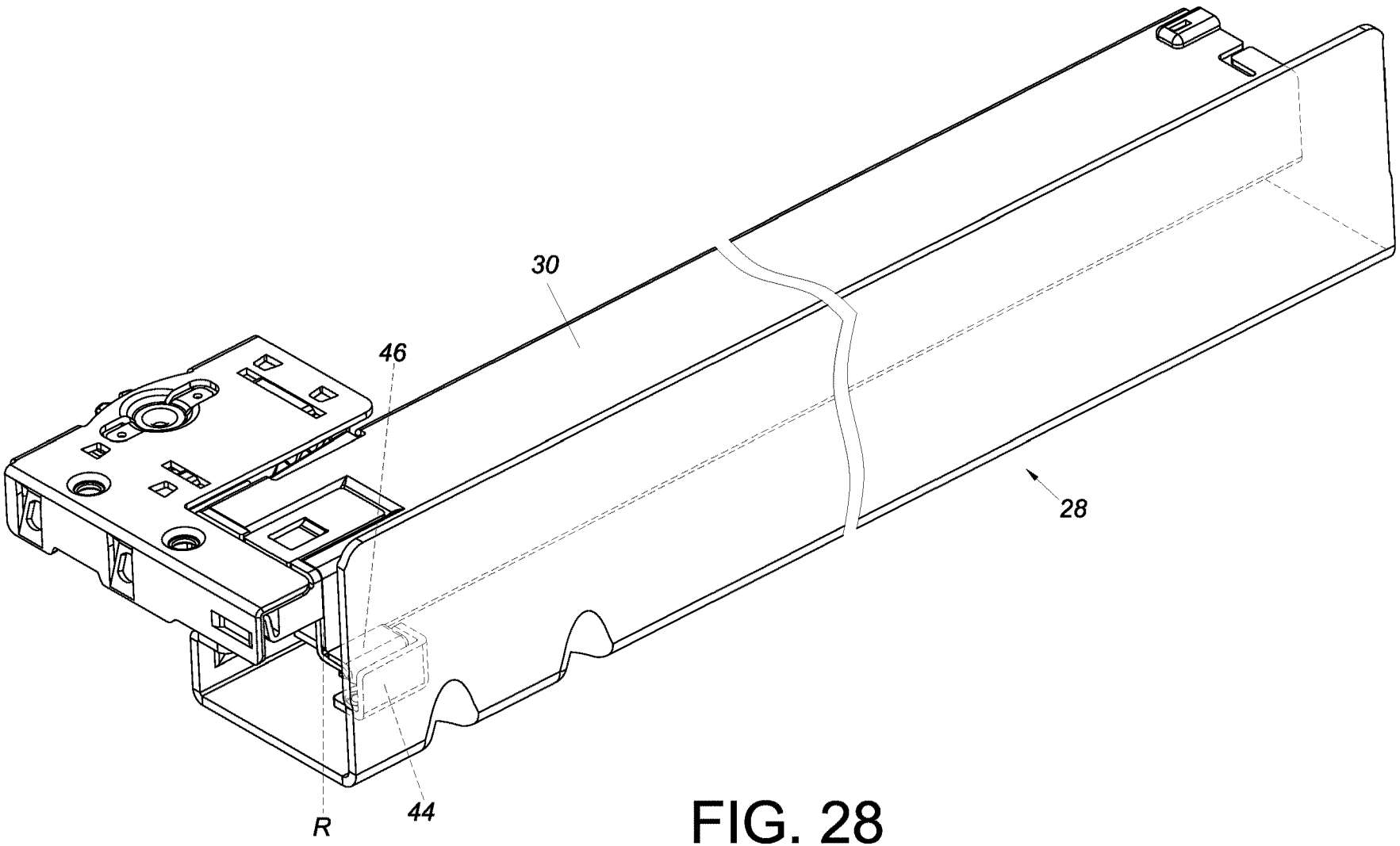
FIG. 28 shows that the second furniture part is at a retracted position with respect to the first furniture part, with the two position-limiting features pressed against each other.

Referring to FIG. 27 and FIG. 28, when a second furniture part (e.g., a drawer or the second rail 28) is at the retracted position R with respect to the first furniture part (e.g., a cabinet body or the first rail 28), the first position-limiting feature 44 and the second position-limiting feature 46 are pressed against each other to prevent the second furniture part from further displacement in the retracting direction D2 from the retracted position R. For example, when the second furniture part is driven by the aforesaid driving force to displace in the retracting direction D2 with respect to the first furniture part and reaches the retracted position R, the second position-limiting feature 46 of the second furniture part is pressed against the first position-limiting feature 44 to keep the second furniture part from excessive retraction with respect to the first furniture part.

The retracting mechanism for movable furniture parts in this embodiment preferably has the following features:

1. The catch member 50 includes the two features 60 and 62 for catching the engaging feature 38 under different conditions (e.g., a normal condition and an abnormal condition) respectively.
2. The catch member 50 includes the resilient leg 72 for direct contact with the engaging feature 38 (e.g., a fixed pin) so as to assist in tilting and displacing the catch member 50 from the first guiding portion 56 to the second guiding portion 58.
3. The resilient leg 72 of the catch member 50 is bent with respect to the third extension portion 70 and is adjacent to or faces the second extension portion 68.
4. When a second furniture part (e.g., a drawer or the second rail 30) is at the retracted position R with respect to the first furniture part (e.g., a cabinet body or the first rail 28), the first position-limiting feature 44 and the second position-limiting feature 46 are pressed against each other so that the second furniture part cannot be further displaced in the retracting direction D2 from the retracted position R.

While the present invention has been disclosed by way of the preferred embodiment described above, the embodiment is not intended to be restrictive of the scope of the invention. The scope of patent protection sought by the applicant is defined by the appended claims.

What is claimed is:

1. A retracting mechanism for movable furniture parts which include a first furniture part and a second furniture part that are displaceable with respect to each other, wherein one of the first furniture part and the second furniture part includes an engaging feature, the retracting mechanism comprising:

a guiding structure including a shared longitudinally extended guiding groove having a first guiding portion and a second guiding portion in communication with the first guiding portion, the first guiding portion being linearly and longitudinally directed and the second guiding portion being angularly directed with respect to the first guiding portion;

a base including at least one guide member extending into the shared guiding groove and being displaceable therein;

a catch member pivotally coupled to the base and including a guiding member extending into the shared guiding groove and being displaceable therein between the first guiding portion and the second guiding portion, the catch member having a first feature and a second feature that are each configured for independently capturing the engaging feature, the catch member further including a main body, a first extension portion, a second extension portion, and a third extension portion, and the first extension portion, the second extension portion, and the third extension portion being connected to the main body, the third extension portion being located between the first extension portion and the second extension portion, and the first feature being located between the first extension portion and the third extension portion; and a resilient member having one end thereof coupled to the base for storing a driving force responsive to displacement of the base in an opening direction of one of the first furniture part and the second furniture part with respect to the other toward a predetermined position;

wherein responsive to the guiding member of the catch member being located in the first guiding portion of the shared guiding groove, the engaging feature is caught by one of the first feature and the second feature of the catch member, and responsive to the guiding member of the catch member being displaced into the second guiding portion of the shared guiding groove, the catch member is pivotally displaced to release the engaging feature from capture by the one of the first feature and the second feature;

wherein responsive to the one of the first furniture part and the second furniture part being in a last stage of retraction with respect to the other in a retracting direction, the driving force acts on and helps retract the one of the first furniture part and the second furniture part.

2. The retracting mechanism of claim 1, wherein the engaging feature is located at the first furniture part, and the retracting mechanism is located at the second furniture part.

3. The retracting mechanism of claim 1, wherein the catch member further includes a resilient leg connected to the third extension portion and extending toward the second extension portion.

4. The retracting mechanism of claim 3, wherein the resilient leg is bent with respect to the third extension portion and is disposed adjacent to the second feature.

5. The retracting mechanism of claim 1, wherein the second feature is located at the second extension portion.

6. The retracting mechanism of claim 5, wherein the second extension portion is made of a flexible material, the second extension portion includes a first section and a second section bent with respect to the first section, and the first section and the second section form an engaging hook as the second feature.

7. The retracting mechanism of claim 3, wherein the resilient leg is configured for working directly with the engaging feature to help tilt the catch member and displace the guiding member of the catch member from the first guiding portion to the second guiding portion of the shared guiding slot.

8. The retracting mechanism of claim 1, further comprising a cushioning device having one end thereof operatively contacting the catch member for reducing the driving force acting on the one of the first furniture part and the second furniture part to thereby producing a cushioning effect in the last stage of retraction.

9. The retracting mechanism of claim 1, wherein the first furniture part includes a first position-limiting feature, the second furniture part includes a second position-limiting feature, and when the second furniture part is at a retracted position with respect to the first furniture part, the first position-limiting feature and the second position-limiting feature are pressed against each other to prevent the second furniture part from displacement from the retracted position in the retracting direction.

10. A retracting mechanism for movable furniture parts which include a first furniture part and a second furniture part displaceable with respect to the first furniture part, wherein the first furniture part includes an engaging feature, the retracting mechanism comprising:

a guiding structure including a shared longitudinally extended guiding groove having a first guiding portion and a second guiding portion extending from a longitudinal end of the first guiding portion;

a base including at least one guide member extending into the shared guiding groove and being displaceable therein;

a catch member pivotally coupled to the base and including a guiding member extending into the shared guiding groove and being displaceable between the first guiding portion and the second guiding portion, the catch member having a first feature and a second feature that are each configured for independently capturing the engaging feature, the catch member further including a main body, a first extension portion, a second extension portion, and a third extension portion, and the first extension portion, the second extension portion, and the third extension portion being connected to the main body, the third extension portion being located between the first extension portion and the second extension portion, and the first feature being located between the first extension portion and the third extension portion; and a resilient member having one end thereof coupled to the base for storing a driving force responsive to displacement of the base in an opening direction of the second furniture part with respect to the first furniture part toward a predetermined position and displacement of the guiding member of the catch member to a position adjacent a distal longitudinal end of the second guiding portion of the shared guiding groove;

wherein subsequent to the engaging feature being caught by one of the first feature and the second feature of the catch member, the catch member is disengaged from the engaging feature responsive to the guiding member of the catch member being displaced into the second guiding portion of the shared guiding groove;

wherein responsive to the second furniture part being in a last stage of retraction with respect to the first furniture part in a retracting direction, the driving force drives the second furniture part to be displaced to a retracted position with respect to the first furniture part.

11. The retracting mechanism of claim 10, wherein the retracting mechanism is located at the second furniture part, the first furniture part includes a first rail, and the second furniture part includes a second rail.

12. The retracting mechanism of claim 10, wherein the catch member further includes a resilient leg connected to the third extension portion and extending toward the second extension portion.

13. The retracting mechanism of claim 12, wherein the resilient leg is bent with respect to the third extension portion and is disposed adjacent to the second extension portion, and the second feature is located at the second feature.

14. The retracting mechanism of claim 13, wherein the second extension portion is made of a flexible material, the second extension portion includes a first section and a second section bent with respect to the first section, and the first section and the second section form an engaging hook as the second feature.

15. The retracting mechanism of claim 12, wherein the second guiding portion of the shared guiding extends angularly from the first guiding portion, and the resilient leg is configured for working with the engaging feature to help tilt the catch member and displace the guiding member of the catch member from the first guiding portion to the second guiding portion of the shared guiding slot.

16. The retracting mechanism of claim 10, wherein the first furniture part includes a first position-limiting feature, the second furniture part includes a second position-limiting feature, and when the second furniture part is at the retracted position with respect to the first furniture part, the first position-limiting feature and the second position-limiting feature are pressed against each other to prevent the second furniture part from displacement from the retracted position in the retracting direction.

17. The retracting mechanism of claim 10, further comprising a cushioning device having one end thereof operatively contacting the catch member for reducing the driving force acting on the second furniture part to thereby produce a cushioning effect in the last stage of retraction.

* * * * *